US005835000A

United States Patent [19]

Ascroft et al.

[11] Patent Number: 5,835,000

[45] Date of Patent: Nov. 10, 1998

[54] CURRENT TRANSFORMER ASSEMBLIES

[75] Inventors: David Ascroft; David Ian Colguhoun, both of Prestbury, England

[73] Assignee: Smiths Industries plc, London, England

[21] Appl. No.: 863,581

[22] Filed: May 27, 1997

[30] Foreign Application Priority Data

Jun. 14, 1996 [GB] United Kingdom ..... 9612504

[51] Int. Cl.[6] ..... H01F 27/02; H01F 38/20; H01F 27/04

[52] U.S. Cl. ..... 336/90; 336/174; 336/175; 336/107; 336/92

[58] Field of Search ..... 336/90, 92, 107, 336/174, 175

[56] References Cited

U.S. PATENT DOCUMENTS

| | | | |
|---|---|---|---|
| 4,210,951 | 7/1980 | Ritter et al. | 361/391 |
| 4,491,818 | 1/1985 | Danenberg et al. | 336/65 |
| 4,623,865 | 11/1986 | Kiesel et al. | 336/65 |
| 4,701,738 | 10/1987 | Preissinger et al. | 336/92 |
| 5,726,846 | 3/1998 | Houbre | 336/165 |

*Primary Examiner*—Michael L. Gellner
*Assistant Examiner*—Anh Mai
*Attorney, Agent, or Firm*—Pollock, Vande Sande & Priddy

[57] ABSTRACT

A current transformer assembly has three pairs of contacts projecting from the upper and lower surface of a mounting plate. Below the plate, the contacts in each pair are interconnected by a conductor embraced by a toroidal current transformer. The transformers are electrically connected to a connector accessible on the upper surface of the plate. Four mounting bolts project from the upper surface of the plate so that the assembly can be connected to cooperating contacts on an equipment panel. The lower surface of the plate is enclosed by a housing.

10 Claims, 2 Drawing Sheets

CURRENT TRANSFORMER ASSEMBLIES

BACKGROUND OF THE INVENTION

This invention relates to current transformer assemblies.

Current transformers are often used to monitor current flow in a circuit, such as for the purpose of detecting excessive power consumption and providing a warning signal or disconnection of power supply. Current transformers take the form of a toroid having a number of turns of a wire. The central aperture of the transformer is threaded onto the current-carrying conductor and the output current is taken from flying leads attached to the toroid winding. This can create a problem because it is necessary to break the current-carrying conductor when the transformer needs to be replaced.

BRIEF SUMMARY OF THE INVENTION

It is an object of the present invention to provide an improved current transformer assembly.

According to one aspect of the present invention there is provided a current transformer assembly including a mounting plate having at least one pair of electrical contacts on a first surface of the plate, the contacts being connected through the plate to a conductor extending between said contacts on the opposite surface of the plate, and the assembly including a current transformer encompassing the or each conductor, and mounting means by which the transformer assembly can be retained with a cooperating assembly and make connection of said contacts.

The assembly preferably includes a connector accessible on the first surface of the plate, the output of the or each current transformer being connected with the connector. The assembly preferably includes a housing, the housing enclosing the opposite surface of the plate. The contacts may be of cylindrical shape and project above the first surface and below the opposite surface of the plate. The assembly may include three pairs of contacts and three current transformers embracing respective conductors extending between respective contacts of each pair. The or each current coil is preferably a toroidal transformer threaded onto the or each respective conductor. The mounting means may comprise a plurality of bolts projecting from the first surface of the plate. The assembly may include a relay connected in series with the or each conductor, the relay preferably being controlled in response to the output of the or each respective current transformer.

A current transformer assembly according to the present invention will now be described, by way of example, with reference to the accompanying drawings.

DETAILED DESCRIPTION OF THE PREFERRED EMBODIMENT

Figure 1:
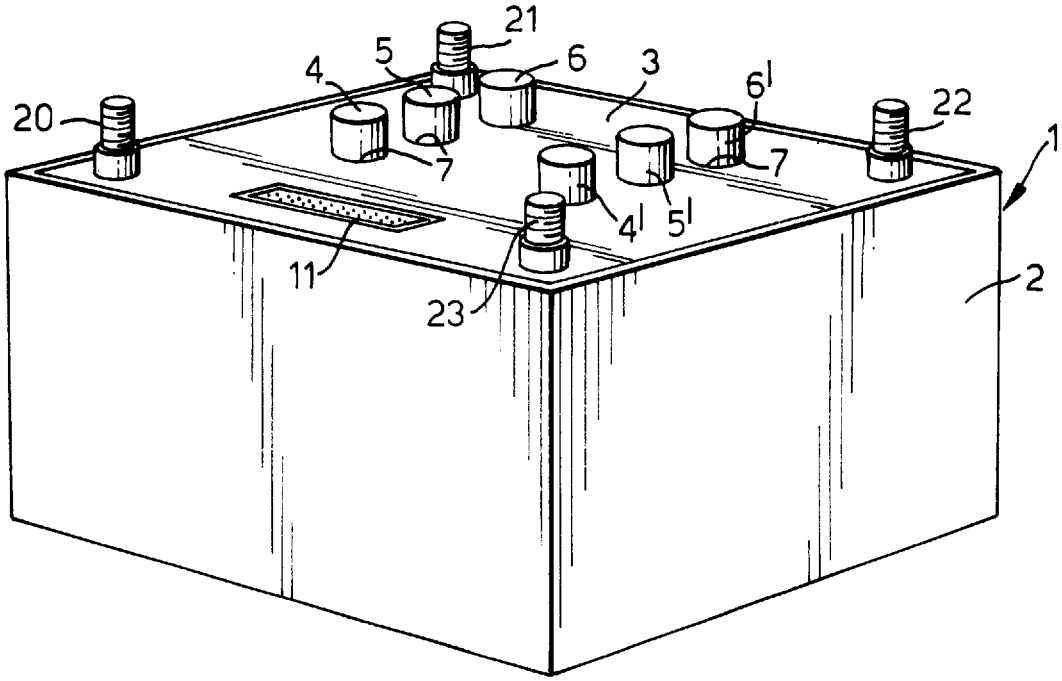
FIG. 1 is a perspective view of the assembly.
Figure 2:
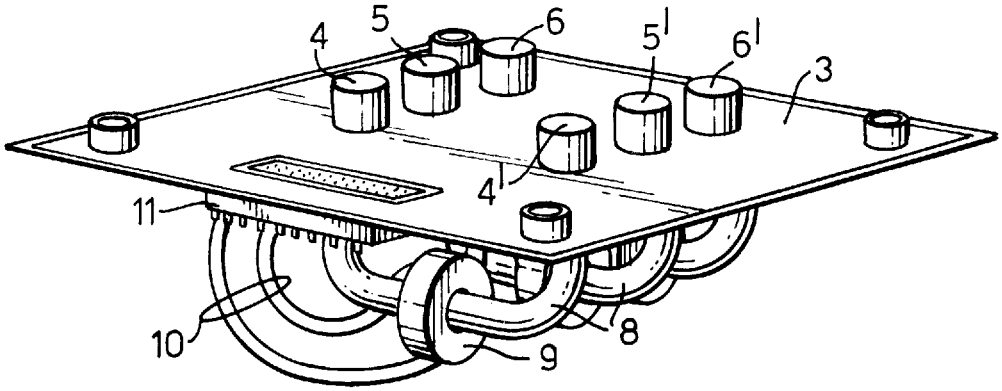
FIG. 2 is a perspective view of a part of the assembly, disassembled.

With reference first to FIGS. 1 to 2, the assembly 1 comprises an outer housing 2 of square shape with a closed bottom. The top of the housing 2 is closed by a removable top mounting plate 3 of an electrically non-conductive material. The top plate 3 supports on its upper surface three pairs of electrical contacts 4 and 4', 5 and 5', and 6 and 6'. The contacts 4 to 6 are of cylindrical shape and project through the plate, extending a short distance above and below the plate. The two contacts 4 and 4', 5 and 5', and 6 and 6' in each pair are connected together below the plate 3 by current-carrying conductors 8 in the form of thick wires or bars. The central part of the wires 8 is spaced below the lower surface of the plate 3 to allow a toroidal, current transformer 9 to be threaded onto each wire. The transformers 9 can be of any conventional kind and are retained in position on the wires 8 by an adhesive. Output wires 10 from each transformer 9 are connected to the rear of a rectangular, multi-pin connector 11 mounted in an aperture in the plate 3, the top of the connector being accessible on the upper surface of the plate.

Figure 3:
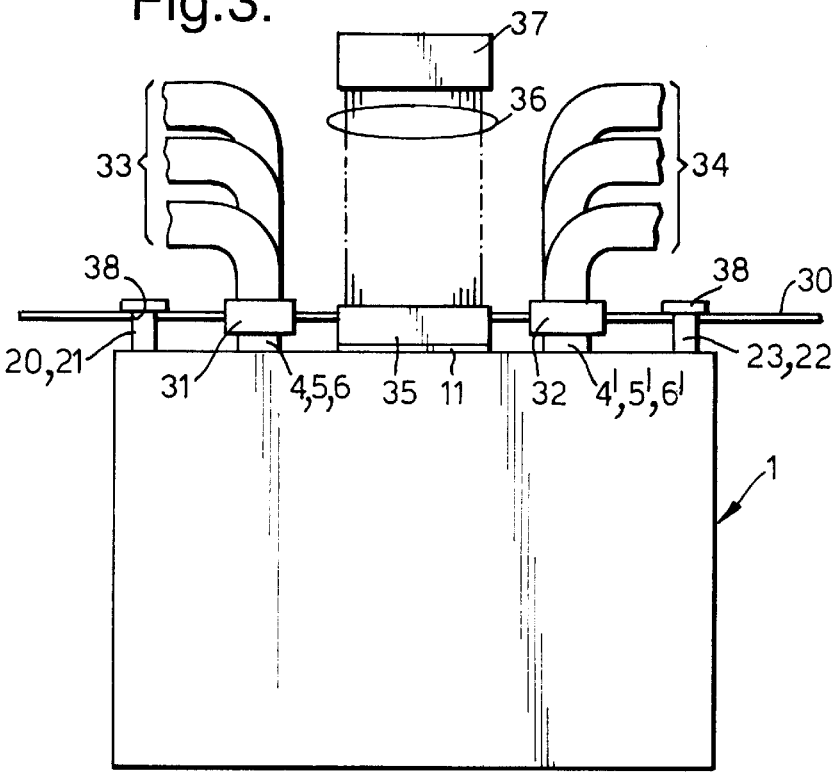
FIG. 3 is a plan view showing the transformer assembly mounted on an equipment panel.

The plate 3 also has four fixing bolts 20 to 23 projecting upwardly at each corner of the plate, which are used to secure the transformer assembly 1 to a cooperating assembly in the form of an equipment panel 30, as shown in FIG. 3. The equipment panel 30 has three, recessed inlet contacts 31 and three outlet contacts 32, arranged to align with and receive respective ones of the inlet and outlet contacts 4 to 6 on the transformer assembly 1. The inlet contacts 31 on the equipment panel 30 are connected to respective ones of three-phase current-carrying busbars 33; the outlet contacts 32 are connected to respective outlet busbars 34. The panel 30 has four apertures 38 located to receive the four fixing bolts 20 to 23 on the transformer assembly 1, so that it is retained on the panel by the bolts. The panel 30 also has a multi-pin connector 36 located to mate with the connector 11 on the transformer assembly 1. Wires 37 extend from the connector 36 to an electrical monitoring unit 38.

In use, the current-carrying busbars 33 are interconnected with the outlet busbars 34 via the wires 8 in the transformer assembly 1. Accordingly, each current transformer 9 will produce an output current proportional to the current flowing along the wire 8 embraced by the transformer. This output current is supplied via the wires 10 to the connector 11 and via the connector 36 and wires 37 to the monitoring unit 38. If any of the current transformers 9 should fail or malfunction, the transformer assembly 1 can be simply removed and replaced. This can be done easily and quickly. The housing 2 ensures that the components of the transformer assembly are protected from contaminants; it also prevents inadvertent access to high voltages.

Figure 4:
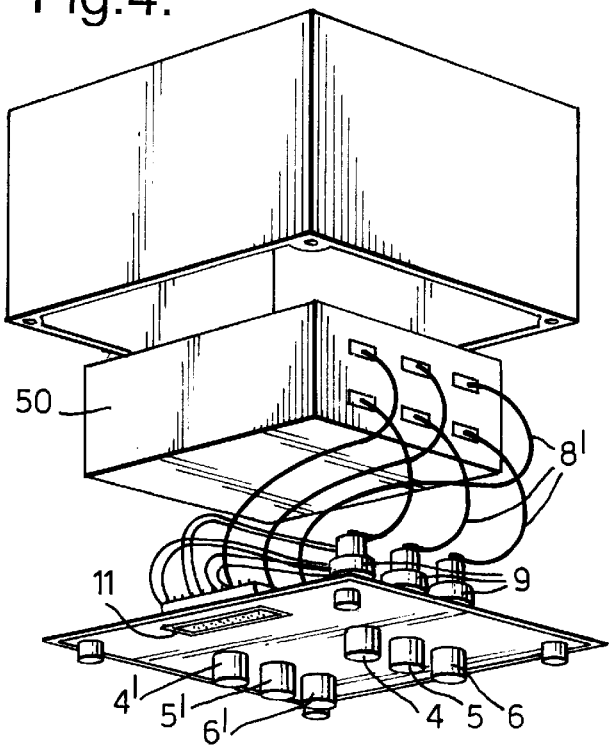
FIG. 4 is a perspective, exploded view of an alternative assembly.

The transformer assembly may include additional components, as shown in FIG. 4. In this arrangement, the housing contains a three-phase relay or contactor unit 50. The contactor unit 50 contains conventional solid state or electromechanical relays and is connected to the wires 8' from the contacts 4 to 6 so that, by opening the relays, current is prevented from being supplied to the output contacts. The contactor 50 may be controlled directly by the outputs from the current transformers 9 or by the monitoring unit 38, via the connector.

What we claim is:

1. An assembly comprising an equipment panel assembly and a current transformer assembly, said current transformer assembly comprising a mounting plate, a pair of first electrical contacts on a first surface of said plate, a conductor extending on an opposite surface of said plate between said contacts, a current transformer encompassing the conductor, a first mounting member, and a housing enclosing said current transformer and said opposite surface of said plate; and said equipment panel assembly comprising a panel, a second pair of electrical contacts on an outer surface of said panel, said second pair of contacts being located to make mating electrical contact with said first contacts, and a second mounting member arranged to engage said first mounting member such that said current transformer assembly can be retained on said panel with said current transformer electrically connected to respond to current flow between said second pair of contacts.

2. An assembly according to claim 1, including a connector accessible on said first surface of the plate, and means connecting an output of said current transformer to said connector.

3. An assembly according to claim 1, wherein said first contacts are of cylindrical shape and project above said first surface and below said opposite surface of said plate.

4. An assembly according to claim 1 including three pairs of said first contacts, three of said conductors extending between respective contacts of each said pair of first contacts, and three current transformers embracing respective ones of said three conductors.

5. An assembly according to claim 1, wherein said current transformer is a toroidal coil threaded onto said conductor.

6. An assembly according to claim 1, wherein said first mounting member comprises a plurality of bolts projecting from said first surface of said plate.

7. An assembly according to claim 1 including a relay connected in series with said conductor.

8. An assembly according to claim 7, wherein said relay is connected with said current transformer such that said relay is controlled in response to the output of said current transformer.

9. An assembly comprising an equipment panel assembly and a current transformer assembly, said current transformer assembly comprising a mounting plate, a plurality of first pairs of electrical contacts on a first surface of said plate, a plurality of conductors extending on an opposite surface of said plate between respective ones of said contacts, a plurality of current transformers encompassing respective ones of the conductors, a first mounting member, and a housing enclosing said current transformers and said opposite surface of said plate; and said equipment panel assembly comprising a panel, a plurality of second pairs of electrical contacts on an outer surface of said panel, said second pairs of contacts being located to make mating electrical contact with respective ones of said first pairs of contacts, and a second mounting member arranged to engage said first mounting member such that said current transformer assembly can be retained on said panel with said current transformers electrically connected to respond to current flow between said second pairs of contacts.

10. An assembly comprising an equipment panel assembly and a current transformer assembly, said current transformer assembly comprising a mounting plate, a pair of first electrical contacts on a first surface of said plate, a conductor extending on an opposite surface of said plate between said pair of first contacts, a current transformer encompassing the conductor, a connector accessible on said first surface of said mounting plate, said connector being connected with an output of said current transformer a first mounting member, and a housing enclosing said current transformer and said opposite surface of said plate; and said equipment panel assembly comprising a panel, a second pair of electrical contacts on an outer surface of said panel, said second pair of contacts being located to make mating electrical contact with said first contacts, and a second mounting member arranged to engage said first mounting member such that said current transformer assembly can be retained on said panel with said current transformer electrically connected to provide an output to said connector in response to current flow between said second pair of contacts.

* * * * *